US005927688A

United States Patent [19]

Lin

[11] Patent Number: 5,927,688

[45] Date of Patent: Jul. 27, 1999

[54] CONTROL VALVE FOR AN AIR PRESSURE BAR

[76] Inventor: Yung-Chi Lin, No. 210, Section 1, Po-Ta Road, Ma-Miao Tsun, Gui-Jen Hsiang, Tainan Hsien, Taiwan

[21] Appl. No.: 08/980,647

[22] Filed: Dec. 1, 1997

[51] Int. Cl.[6] ..... F16K 31/00

[52] U.S. Cl. ..... 251/319; 251/367; 251/904

[58] Field of Search ..... 251/904, 367, 251/319

[56] References Cited

U.S. PATENT DOCUMENTS 3,847,371 11/1974 Norton et al. ..... 251/319
4,552,336 11/1985 Pastrone ..... 251/904

FOREIGN PATENT DOCUMENTS 48212 12/1982 Germany ..... 251/319
2117071 10/1983 United Kingdom .

*Primary Examiner*—A. Michael Chambers

[57] ABSTRACT

A control valve for an air pressure bar includes a valve cap having an annular groove in a outer surface, a valve body having an annular ridge and an aperture in an annular wall, a valve base and a pin rod. The aperture producing elasticity to let the valve body combined tightly with the valve cap and a stepped notch in an annular wall below the upper center cavity of the valve body form an air passageway for gas to flow through. The valve body and the valve base are combined together by an annular ridge on an inner surface of a lower center cavity of the valve body and an annular groove in an outer surface of the valve base. The valve base has a stop on an inner surface of a center hole to stop a bottom of the pin rod not falling out of the valve body.

3 Claims, 3 Drawing Sheets

CONTROL VALVE FOR AN AIR PRESSURE BAR

BACKGROUND OF THE INVENTION

This invention relates to a control valve for an air pressure bar used in a chair or the like so as to adjust its height or angle, particularly to one having components provided with an annular ridges or grooves to engage with each other to quicken assemblage of the control valve, and the valve body provided with an air passageway for gas to flow through smoothly, and a valve base provided with a stop for stopping and supporting a pin rod from falling off the valve body, enhancing convenience in using it.

Utilization of an air pressure bar able to reciprocate for a distance is already a well-known art for adjusting height or angle of a chair. As shown in FIG. 1, a conventional control valve A for an air pressure device, opens and closes to move a piston rod in an inner and an outer oil tube. In order to form an air passageway for air, a valve body A1 has a center hole A2 for placing a separating ring B and a pin rod C fitting in the separating ring B. The separating ring B at least has an upper flange B2, an air hole B4 in an annular wall B3 communicating with the shaft hole B1, letting the pin rod C movable and functioning to open and close the air flowing passageway with the separating ring B and two gaskets E, E' during reciprocating movement of the pin rod C.

As to this conventional valve A, there is a disadvantage that the pin rod C is movable in the separate ring B, but the ring B is not allowed to move axially in the valve body A1. So an annular gasket D is provided to fit in a lower opening A3 of the center hole A2, and then plural tongues A4 are formed by punching the side edge of the lower opening A3, as shown with dotted lines in FIG. 1 so that the separating ring may be restricted in the center hole A2 of the valve body A. This kind of structure is disadvantageous for making and assemblage.

As to the pin rod C of the conventional valve A, there is also a disadvantage that the pin rod C has a smaller diameter intermediate portion C1 between two larger diameter portions C2 and C3. But the valve body A has at least a side (the opening A3) loaded with high pressured gas, so the pin rod C has to form a small diameter section C1 in the larger diameter portion C3, and fixed with a largest diameter head C4 on the section C3 for preventing the pin rod C from completely moving in the valve body A1 or in the separating ring B. And in pressing or riveting the head C4 on the section C31, the section C1 may be easily bent or disfigured. The larger portions C2, C3 should have a different size from the smaller portion C1 to correspond to the separating ring B and the annular gaskets E, E', and the C1 is commonly 3 mm. Then a comparative large force should be used to operate the control valve A or the pin rod C. Then it is a cause to attract less buyers.

Another disadvantage of the pin rod C is that ramps C5, C5' between the two larger portions C2, C3 and the smaller portion C1 have to be ground two or three times for preventing the annular gasket E from hurt during movement of the pin rod C.

SUMMARY OF THE INVENTION

The main purpose of the invention is to offer a control valve for an air pressure bar, having a simple structure for manufacture, assemblage and use.

A main feature of the invention is a valve cap, a valve body and a valve base combined together as integral, having an air passageway formed with an aperture in an annular wall defining an upper center cavity of the valve body and a stepped notch in an annular wall under center cavity, and a stop formed in an inner surface near a bottom of a center hole of the valve base for stopping and supporting a pin rod to prevent the pin rod from falling off the valve body.

BRIEF DESCRIPTION OF DRAWINGS

This invention will be better understood by referring to the accompanying drawings, wherein.

DETA1LED DESCRIPTION OF THE PREFERRED EMBODIMENT

Figure 1:
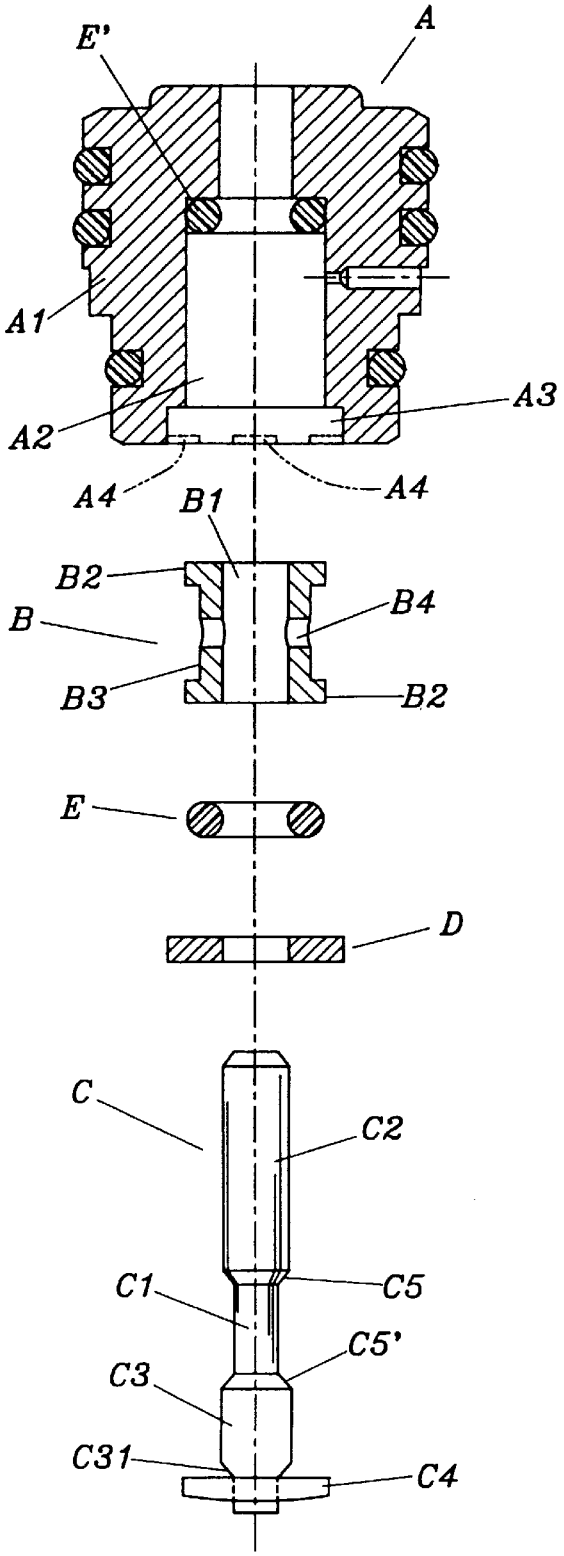
FIG. 1 (PRIOR ART)
FIG. 1 is an exploded perspective view of a conventional control valve for an air pressure bar, with dotted lines indicating relative position of tongues.
Figure 2:
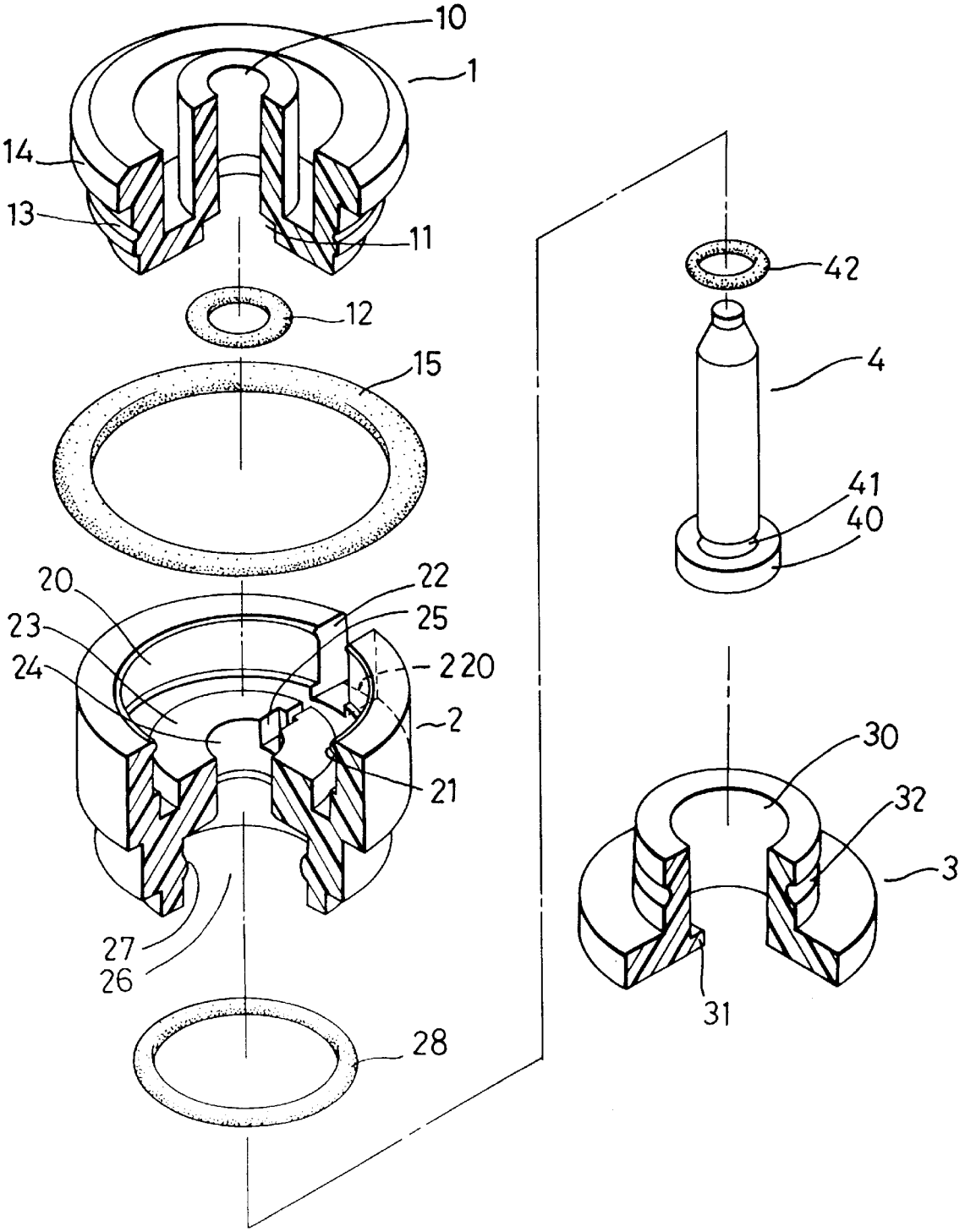
FIG. 2 is an exploded perspective view of a control valve for an air pressure bar in the present invention.

A preferred embodiment of a control valve for an air pressure bar in the present invention, as shown in FIG. 2, includes a valve cap 1, a valve body 2, a valve base 3 and a pin rod 4.

The valve cap 1 is made of plastic, having a center hole 10, a lower end 11 of the center hole 10, an annular gasket 12 fitted in the lower end 11, an annular groove 13 in an outer surface, a flange 14 around an upper end, and an annular gasket 15 fitting around the outer surface below the flange 14.

The valve body 2 is made of plastic, located under the valve cap 1, having an upper center cavity 20, an annular ridge 21 on an inner upper surface of an annular wall defining the upper center cavity 20, an aperture 22 provided in the annular wall defining the cavity 20, a small groove 220 formed in an outer wall of the aperture 22, an annular projecting-inward wall 23 in the cavity 20, a center hole 24 formed in the annular wall 23, a stepped notch 25 in the annular wall 23 facing the aperture 22, a lower center cavity 26 formed in a lower portion, an annular ridge 27 formed on an inner surface defining the lower cavity 26, and an annular gasket 28 fitting around a lower end surface of the valve body 2.

The valve base 3 is made of plastic, located under the valve body 2, having a center hole 30, a stop 31 formed to project inward from an inner lower surface of the hole 30, and an annular groove 32 formed in an outer surface of the valve base 3.

The pin rod 4 is located in the center hole 30 of the valve base 3 and protrudes up out of the center hole 10 of the valve cap 1, having a flange 40 formed at a lower end, an annular groove 41 just abutting on the flange 40, and a gasket 42 fitting in the annular groove 41.

Figure 3:
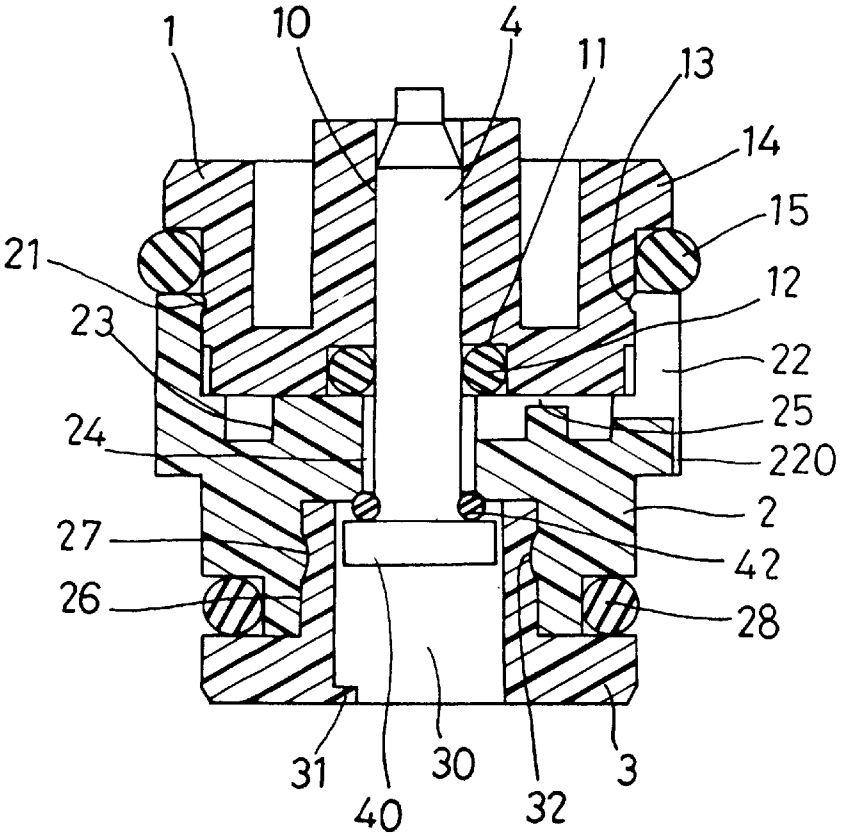
FIG. 3 is a cross-sectional view of the control valve for an air pressure bar in the present invention; and, FIG. 4 is a cross-sectional view of the control valve for an air pressure bar in the present invention.

In assembling, referring to FIGS. 2 and 3, firstly, the annular gasket 12 is fitted in the lower end 11 of the valve cap 1, and the annular gasket 15 is fittted around the outer surface of the flange 14 of the valve cap 1. Then, the valve cap 1 is combined with the valve body 2, inserted and clamped in the cavity 20 with elasticity caused by the aperture 22, with the annular groove 13 engaging the annular ridge 21. Next, the gasket 42 is fitted around the annular groove 41 of the pin rod 4, and then the pin rod 4 inserted from under in the center hole 24 of the valve body 2, extending up and protruding out of the center hole 10 of the valve cap 1. Then, the annular gasket 27 is fitted around the outer surface of the bottom of the valve body 2. After that, the valve base 3 is combined with the valve body 2, with the annular ridge 27 engaging the annular groove 32, and with the stop 31 able to stop and support the bottom of the pin rod 4. Then this control valve is finished in assemblage.

Figure 4:
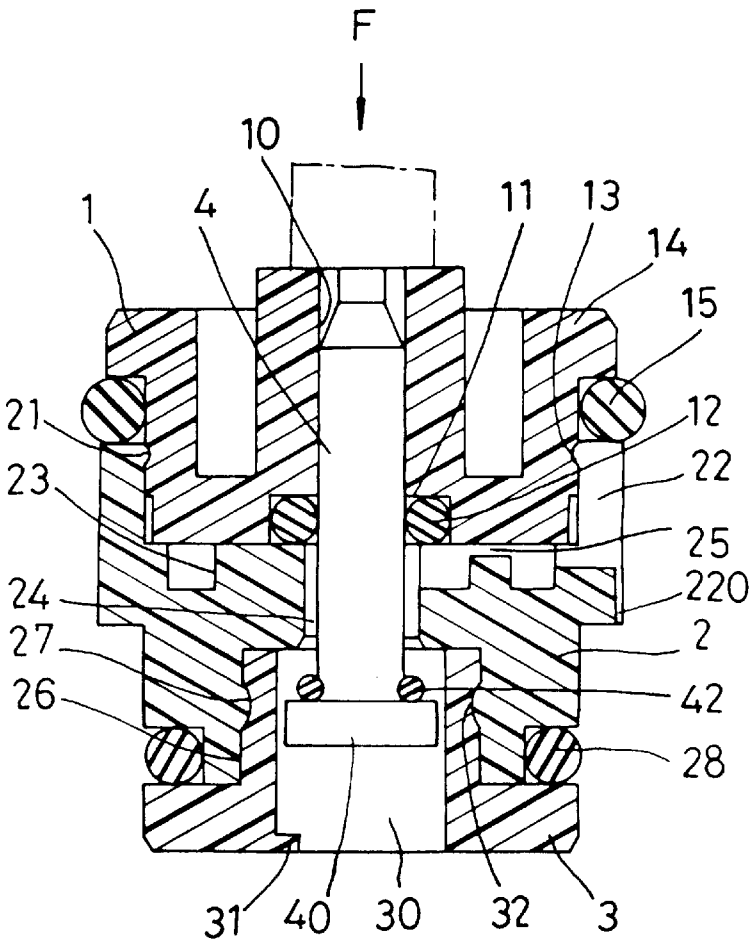

In using, referring to FIGS. 3 and 4, when the pin 4 is compressed down by an exterior force F, the flange 40 together with the gasket 42 separates from the center hole 24 of the valve body 2, moving from a sealing position as shown in FIG. 3 to an open position as shown in FIG. 4, wherein the control valve is open. Therefore, high pressured air flows through the aperture 22, the stepped notch 25 and into the center hole of the valve base 3, pressing and moving a piston rod (not shown in Figures) of the air pressure bar in adjusting the height or angle of a chair or the like.

When the exterior force F disappears, the high air pressure in the center hole 30 of the valve base 3 will push and move the pin 4 to the sealing position, blocking the air passageway, keeping the piston rod or the bar immovable at the position, with air force in an upper side and that in a lower side maintained equal and balanced. Provided that the outer surface of the valve body 2 and the inner surface of the cylinder (not shown in Figures) of the air pressure bar closely contact with each other, air cannot flow smoothly in the conventional control valve for an air pressure bar. On the contrary, the control valve in the present invention can let air flow smoothly, by means of the groove 220 of the valve body 2 enabling air to flow through.

After the control valve is combined in the cylinder of an air pressure bar, high pressured air must be filled in the cylinder, and the high pressured air will flow through the air passageway formed by the aperture 22 and the stepped notch 25 and into the center hole 30 of the valve base 3, pressing the pin rod 4 move down with extremely large force and blocked by the stop 31 of the valve base 3, without possibility of dropping of the pin rod 4 out of the valve body 2, and thus never losing function of the control valve.

The control valve according to the invention surely possesses the following advantages, as can be seen from the aforesaid description.

1. The components are made of plastics, formed with ejecting shooting process, not needing other extra processes, enhancing productivity and lowering cost at the same time.

2. Air can flow smoothly by means of the groove 25 formed in the outer surface of the aperture of the valve body.

3. The pin rod never falls out of the valve body by means of a stop formed in an inner surface of the valve base, always keeping the control valve operable without losing its function.

4. Its whole structure is very simple, convenient for manufacturing and quick for assembling.

While the preferred embodiment of the invention has been described above, it will be recognized and understood that various modifications may be made therein and the appended claims are intended to cover all such modifications which may fall within the spirit and scope of the invention.

What is claimed is:

1. A control valve for an air pressure bar comprising:

a valve cap having a center hole, a lower end of said center hole, an annular gasket fitted in said lower end, a flange formed on an upper end, and an annular gasket fitted under said flange;

a valve body located under said valve cap, having an upper center cavity, a lower annular wall protruding inward from an inner surface of an annular wall defining said upper center cavity, a center hole defined by said lower annular wall, and a lower center cavity formed in a lower portion;

a valve base located under said valve body, having a center hole, and an annular gasket fitting around an outer surface of a bottom;

a pin rod having a small diameter upper portion extending in said center hole of said valve base and through said upper center cavity to protrude out of said center holes of said valve cap, having a flange of a larger diameter than said upper center hole of said upper center hole of said valve body, said upper portion having an annular groove in its lower end abutting said flange, and an annular gasket fitting around said annular groove; and, characterized by said valve cap, said valve body and valve base combined with one another as integral, said annular wall defining said upper center cavity of said valve body having an aperture, said lower annular wall of said valve body provided with a stepped notch, said aperture and said stepped notch forming an air passageway for gas to flow through, said center hole of said valve base provided with a stop on an inner surface near a bottom of said valve base, said stop protruding inward in said center hole able to stop and support the bottom of said pin rod so as to prevent said pin rod from falling out of said valve body, said control valve thus controlling a piston rod of said air pressure bar to move and stop in adjusting the height or angle of a chair or the like.

2. The control valve for an air pressure bar as claimed in claim 1, wherein said valve cap further has an annular gasket fitting around its outer surface, said valve body further has an annular ridge formed on an upper end of an inner surface defining said upper center cavity and an annular ridge formed on an inner surface defining said lower center cavity, said valve base further has an annular groove in an outer surface, said valve cap, said valve body and said valve base are combined with one another as integral by means of said annular ridges and said annular grooves engaging with one another.

3. The control valve for an air pressure bar as claimed in claim 1, wherein said valve body is provided with a small groove in an outer surface of a wall of said aperture in said annular wall defining said upper center cavity, enabling gas to flow when said outer surface of said valve body closely contact with a cylinder of said air pressure bar.

* * * * *